US006573644B1

(12) United States Patent
Minami et al.

(10) Patent No.: US 6,573,644 B1
(45) Date of Patent: Jun. 3, 2003

(54) COLOR CATHODE RAY TUBE HAVING A ONE-DIMENSIONAL TENSION MASK WITH A PERFORATED REGION

(75) Inventors: Go Minami, Osaka (JP); Shiro Kashihara, Shiga (JP); Shigenari Oshima, Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/409,489

(22) Filed: Sep. 30, 1999

(30) Foreign Application Priority Data

Oct. 30, 1998 (JP) ..... 10-310039

(51) Int. Cl.[7] ..... H01J 29/07; H01J 29/80
(52) U.S. Cl. ..... 313/402; 313/403; 313/407
(58) Field of Search ..... 313/402, 403, 313/407

(56) References Cited

U.S. PATENT DOCUMENTS 4,748,371 A * 5/1988 Bauder ..... 313/407
4,942,333 A * 7/1990 Knox ..... 313/402
5,214,349 A 5/1993 Sakata et al. ..... 313/407
5,554,909 A * 9/1996 Brennesholtz ..... 313/402
6,097,142 A * 8/2000 Ko ..... 313/402

FOREIGN PATENT DOCUMENTS

| | | |
|---|---|---|
| EP | 0 354 617 | 2/1990 |
| EP | 0 813 225 | 12/1997 |
| JP | 6-096683 | 4/1994 |

* cited by examiner

*Primary Examiner*—Nimeshkumar D Patel
*Assistant Examiner*—Sikha Roy
(74) *Attorney, Agent, or Firm*—Merchant & Gould, P.C.

(57) ABSTRACT

A color cathode ray tube has a color selection electrode structure made by stretching and welding a color selection electrode having a plurality of apertures to a frame while applying tension in the minor axis direction. A non-perforated region gradually becomes wider from a center portion to both end portions in the minor axis direction. Thus, sufficient tension is applied in the peripheral portion of the perforated region in the major axis direction of the color selection electrode, so that vibrations do not occur easily and the color selection electrode does not warp. Therefore, a color cathode ray tube with excellent color purity can be obtained.

8 Claims, 4 Drawing Sheets

COLOR CATHODE RAY TUBE HAVING A ONE-DIMENSIONAL TENSION MASK WITH A PERFORATED REGION

BACKGROUND OF THE INVENTION

1. Field of the Invention

The present invention relates to a color cathode ray tube used in, for example, a television or a computer display. It relates in particular to a color selection electrode structure with a one-dimensional tension mask, in which a color selection electrode is stretched in the minor axis or the major axis direction.

2. Description of the Prior Art

In general, a color cathode ray tube has a color selection electrode structure including a color selection electrode for selecting by color three electron beams emitted from an electron gun and a frame for holding this color selection electrode.

There are several types of color selection electrodes, such as press-masks prepared by pressing a flat plate member provided with a plurality of, for example, slotted, round, or elliptical apertures into a predetermined curved shape and welding it to a frame (see FIG. 4(*a*)), two-dimensional tension masks in which a similar plate member having a plurality of apertures is stretched and welded to a frame while applying tension in both the minor and major axis directions (see FIG. 4(*b*)), one-dimensional tension masks in which a similar plate member having a plurality of apertures is stretched and welded to a frame while applying tension in either the minor or the major axis direction (see FIG. 4(*c*)), and aperture grilles in which a member including a plurality of metallic slender elements is stretched and welded to a frame while applying tension to it (see Publication of Japanese Unexamined Patent Application (Tokkai) No. Hei 4-163830).

Recently, panels of color cathode ray tubes are designed to be flatter, because this reduces the reflection of external light and improves their appearance. A flatter panel requires that the color selection electrode becomes flatter as well, in order to maintain a proper distance between the phosphor screen and the color selection electrode.

However, making a press-mask flat causes larger "doming," which means that, due to the absorption of electron beams, the thermal expansion of the color selection electrode increases, causing a displacement of the apertures in the color selection electrode. As a result, electron beams passing through these apertures do not strike the predetermined phosphors correctly, which can lead to color irregularities. In addition, since the curved surface is formed by pressing, making it flat is likely to cause a permanent deformation (depression) due to a shock by dropping. Therefore, it is very difficult to make the color selection electrode flat.

In the two-dimensional tension mask, since tension is applied in both the minor and major axis directions of the color selection electrode, it is difficult to maintain a proper balance between the tension in these directions such that the color selection electrode does not warp.

Also, the aperture grille with a plurality of stretched metallic slender elements causes problems in that an external shock easily can cause vibrations of the color selection electrode, and such vibrations can be large and hard to stop. Furthermore, handling of the color selection electrode during assembly is difficult, because the slender metallic elements tend to get tangled and break.

Compared with these types of color selection electrodes, the one-dimensional tension mask has an advantageous structure with regard to these problems. Therefore, it has been increasingly adopted for the color selection electrode in color cathode ray tubes with a flat panel.

However, in the one-dimensional tension mask, if the color selection electrode is stretched on a frame which is curved along the major axis while applying tension in the minor axis direction, the non-perforated region located outside the perforated region in a major axis direction is stronger than the perforated region. Therefore, stress concentrates in the non-perforated region, and it is difficult to apply a tension in the peripheral portion of the perforated region in the major axis direction (near the non-perforated region). As a result, the color selection electrode is likely to vibrate in this peripheral portion due to insufficient tension.

On the other hand, the one-dimensional tension mask has non-aperture portions (called "bridge portions") between adjacent apertures in the perforated region of the color selection electrode. Thus, even when the color selection electrode is stretched with a tension applied only in the minor axis direction, a slight force is exerted in the major axis direction as well. In general, if this force in the major axis direction is too small, the color selection electrode warps. In particular, a heat treatment in the manufacturing process of the color cathode ray tube can make such warps conspicuous and causes misalignment of the apertures.

SUMMARY OF THE INVENTION

In order to solve these problems, it is an object of the present invention to provide a color cathode ray tube with excellent color purity having a color selection electrode structure in which vibrations do not occur easily and the color selection electrode does not warp, because a sufficient tension is applied in the peripheral portion of a perforated region of the color selection electrode.

In order to solve the problems mentioned above, a color cathode ray tube in accordance with the present invention includes an envelope made of a panel having an inside surface on which a phosphor screen is formed and a funnel; a color selection electrode arranged inside the envelope in opposition to the phosphor screen; and a frame for fixing and holding the color selection electrode. The color selection electrode is stretched by the application of tension in either a minor axis direction or a major axis direction. The color selection electrode includes a perforated region provided with a plurality of apertures arranged in predetermined pitch, and a non-perforated region arranged outside the perforated region with respect to a direction that is substantially perpendicular to the direction in which the color selection electrode is stretched. The non-perforated region gradually widens from a center portion towards end portions in the direction in which the color selection electrode is stretched.

With such a cathode ray tube, the tension in the peripheral portion of the color selection electrode in the direction that is substantially perpendicular to the direction in which the color selection electrode is stretched can be made substantially equal to that in the center portion. Also, it is possible to maintain a force in this direction in the peripheral portion with respect to this direction. Accordingly, vibrations in the peripheral portion of the color selection electrode can be suppressed. In addition, warping of the color selection electrode can be suppressed, so that a misalignment of apertures does not occur. Thus, a high quality color cathode ray tube with excellent color purity can be provided.

It is preferable that $1.2 \leqq b/a \leqq 6.0$ is satisfied, wherein "a" is a width of the center portion of the non-perforated region, and "b" is a width of the end portions.

If this relationship is satisfied, the tension in the peripheral portion of the perforated region of the color selection electrode with respect to a direction that is substantially perpendicular to the direction in which the color selection electrode is stretched can be kept within a desired range.

It is preferable that an edge of the color selection electrode in the center portion of the non-perforated region and edges of the end portions of the non-perforated region are connected by a smooth curve or a straight line.

With this configuration, a smooth stress distribution in the end portions in both sides with respect to the direction that is substantially perpendicular to the direction in which the color selection electrode is stretched can be attained.

It is preferable that half-etched holes are provided in the non-perforated region. Throughout this specification, "half-etched holes" refers to holes that are etched only partially through the thickness of the sheet.

With such a configuration, stress concentrations in the non-perforated region can be reduced, thereby increasing the tension applied to the peripheral portion of the color selection electrode in a direction that is substantially perpendicular to the direction in which the color selection electrode is stretched.

It is preferable that the direction in which the color selection electrode is stretched is the minor axis direction.

DESCRIPTION OF THE PREFERRED EMBODIMENTS

The following is a detailed description of the present invention, with reference to the accompanying drawings.

First Embodiment

Figure 1:
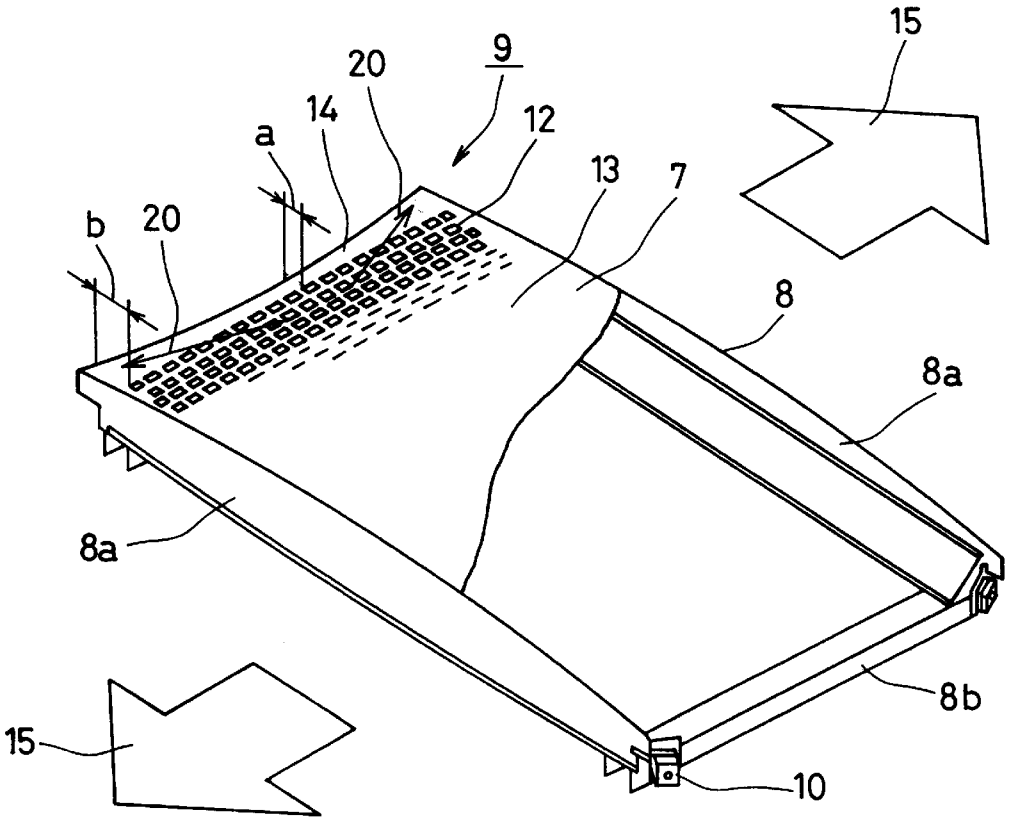
FIG. 1 is a perspective view showing a color selection electrode structure of a color cathode ray tube according to the first embodiment according of the present invention.
Figure 2:
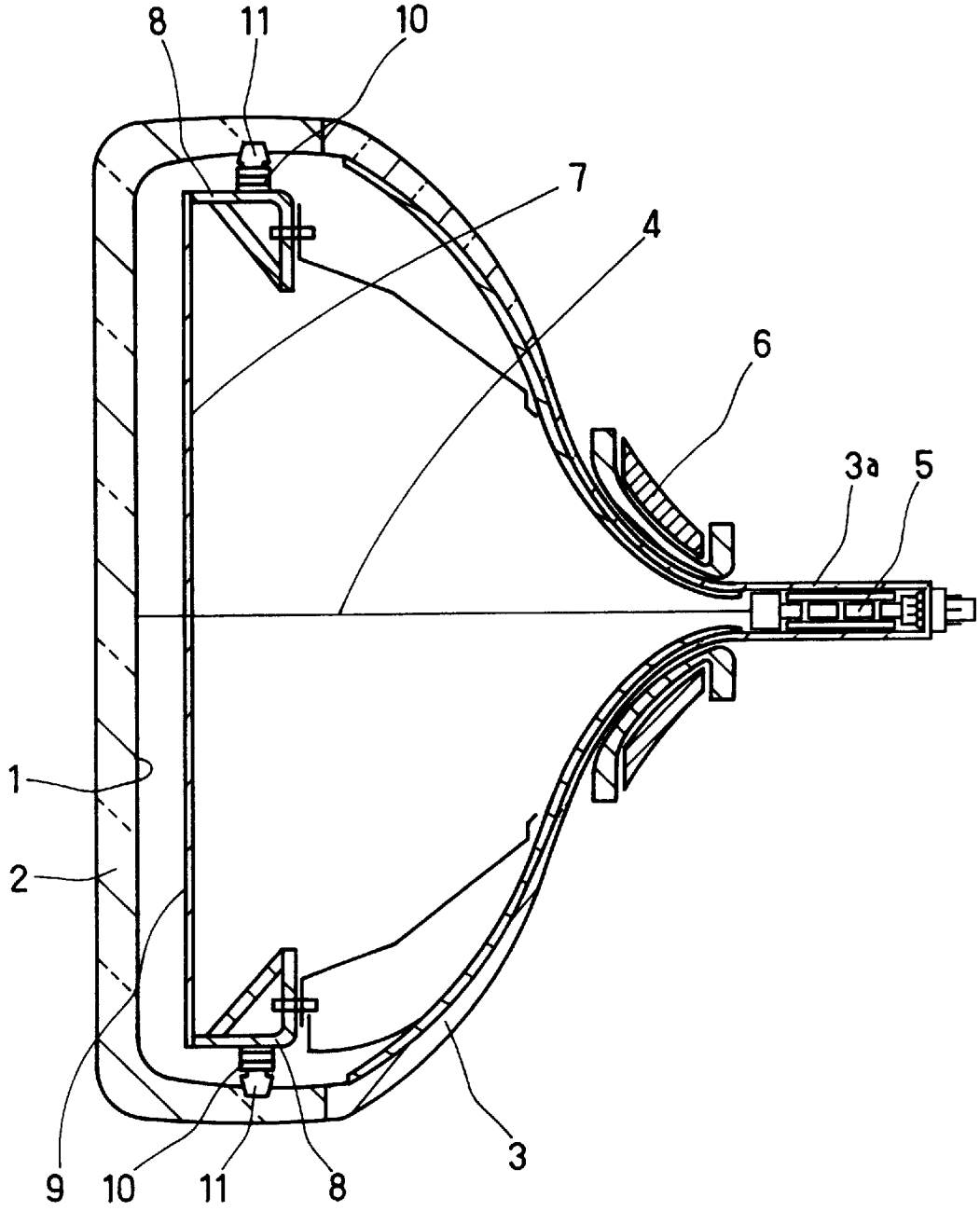
FIG. 2 is a sectional side elevation showing a color cathode ray tube according to the first embodiment of the present invention.

FIG. 2 shows a sectional side elevation of a color cathode ray tube in accordance with the first embodiment. FIG. 1 shows a perspective view of a color selection electrode structure of a color cathode ray tube of the present invention.

As is shown in FIG. 2, a color cathode ray tube according to the present invention includes an envelope having a panel 2 on whose inner surface a phosphor screen 1 is formed, and a funnel 3 connected to the rear side of the panel 2. An electron gun 5, which emits an electron beam 4, is provided within a neck portion 3*a* of the funnel 3. A deflection yoke 6 for deflecting the electron beam 4 is provided on a peripheral surface of the funnel 3. Phosphor dots of three colors are applied to the inner surface of the panel 2, thereby forming the phosphor screen 1. A plate-shaped color selection electrode 7 is arranged substantially parallel to the phosphor screen 1. The color selection electrode 7 has a plurality of apertures formed by etching a flat plate and aligned in order, and selects the three electron beams 4 emitted from the electron gun 5 according to color. The color selection electrode 7 is held by a frame 8, thereby forming a color selection electrode structure 9. The color selection electrode structure 9 is supported within the envelope by engaging an elastic support 10 installed in the frame 8 into a panel pin 11 embedded in the panel 2.

As is shown in FIG. 1, the color selection electrode structure 9 is formed by stretching and welding the color selection electrode 7 to the frame 8 while applying tension in the minor axis direction (i.e. arrow directions 15.) The frame 8 includes a pair of long side members 8*a* having a substantially triangular cross section and a pair of short side members 8*b* having a substantially U-shaped cross section. The front surface of the long side members 8*a* (i.e. the surface to which the color selection electrode 7 is welded) is a curved surface (cylindrical surface), projecting toward the phosphor screen with a predetermined radius of curvature. Therefore, the color selection electrode 7 is fixed to the frame 8 while being curved along its major axis.

The color selection electrode 7 contains a perforated region 13 having a plurality of substantially elliptical apertures 12 and two non-perforated regions 14 outside the perforated region 13 in the major axis direction. The width "b" of the non-perforated regions 14 with respect to the major axis direction at the two end portions in the minor axis direction is larger than the width "a" of a center portion.

The following is an explanation of a method for manufacturing a color selection electrode structure 9 of a color cathode ray tube according to the present embodiment. First, the side surfaces of the long side members 8*a* of the frame 8 are compressed at 3 to 9 compression points while applying a load of predetermined distribution within the elastic region. Then, while maintaining this pressure, a color selection electrode 7 is stretched in the minor axis direction (i.e. arrow directions 15), applying a total tension of approximately 200 kgf, and fixed by welding it onto the curved surfaces of the long side members 8*a*. Finally, when the load is removed that has been applied to the long side members 8*a*, a tension of the desired distribution acts on the color selection electrode 7. In this way, the color selection electrode structure 9 is produced.

In the present embodiment, for example, a color selection electrode structure used in a color cathode ray tube for a 68-cm (29 inch) television was produced.

The color selection electrode has a plate thickness of 0.1 mm, and is made of Fe, 42% Ni—Fe or 36% Ni—Fe, for example. The color selection electrode has a plurality of substantially elliptical apertures arranged with a predetermined pitch and distribution. The color selection electrode has a substantially rectangular perforated region of (vertically by horizontally) 384 mm×509 mm. The width in the major axis direction of the non-perforated regions located outside the perforated region in the major axis direction is 5 mm in a center portion and 11.3 mm in both end portions with respect to the minor axis direction. In addition, edges of these portions of the non-perforated regions are connected by a smooth curve with a curvature radius of R=3338 mm.

The frame contains a pair of long side members made of 36% Ni—Fe with 1.4 mm plate thickness having a substantially triangular cross section, and a pair of short side members made of 42% Ni—Fe also with 1.4 mm plate thickness having a substantially U-shaped cross section. Its size is (vertically by horizontally) 414 mm×534 mm.

Figure 3:
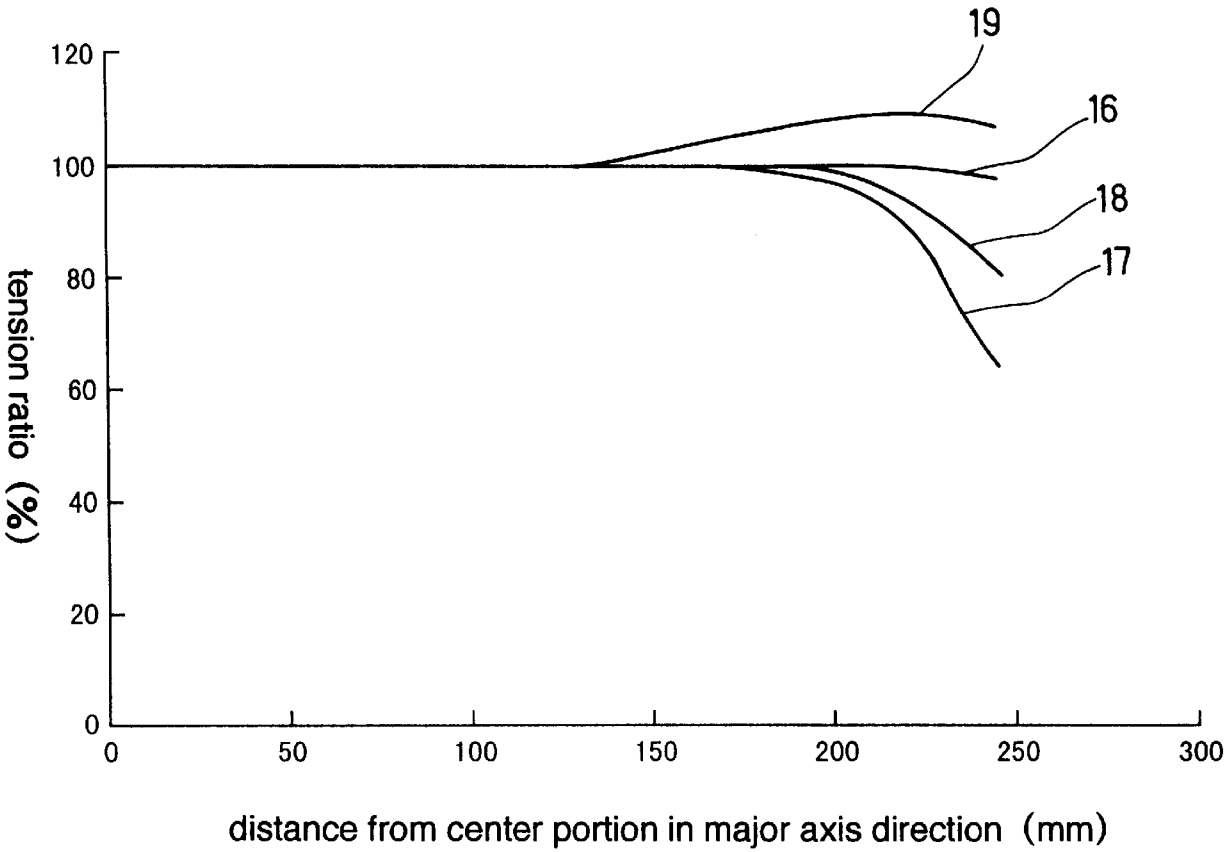
FIG. 3 is a graph showing the ratio between the local tension and the tension in a center portion of the perforated region on a color selection electrode of the present invention as a function of the distance from the center portion in the major axis direction.
Figure 4:
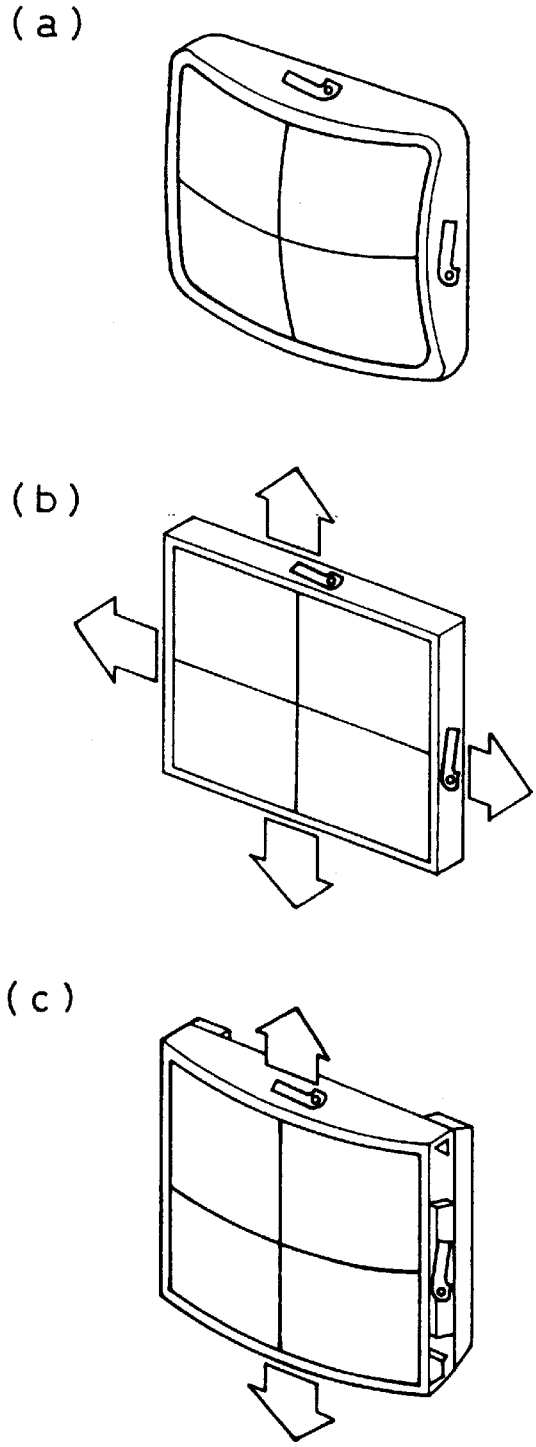
FIG. 4 PRIOR ART
FIGS. 4(*a*) to (*c*) are perspective views showing several types of color selection electrode structures.

FIG. 3 shows the result of an experiment illustrating the effect of the present embodiment. The graph in FIG. 3 illustrates the ratio between the local tension and the tension in a center portion of the perforated region on the stretched and welded color selection electrode, as a function of the distance from the center portion with respect to the major axis direction. The four curves 16 to 19 indicate different width ratios between the center portion and both end portions of the non-perforated regions with respect to the minor axis direction. If the width in the center portion of the non-perforated regions is expressed by "a" and the width in both end portions of the non-perforated regions in the minor axis direction by "b", then curve 16 illustrates b/a=2.26 (in the present embodiment, a=5 mm, b=11.3 mm), curve 17 illustrates b/a=1.0, curve 18 illustrates b/a=1.2, and curve 19 illustrates b/a=6.0.

Curve 16 shows the present embodiment, in which the amounts of tension in the peripheral portions in the major axis direction and in the center portion of the perforated region are substantially equal. This is possible because, by making the non-perforated regions in both end portions in the minor axis direction wider than in the center portion, a stress is applied in a diagonal axis direction (arrow direction 20 in FIG. 1) of the color selection electrode when stretching, thereby decreasing the stress on the non-perforated regions in the direction in which the color selection electrode is stretched, so that the tension which is applied in the peripheral portion in the major axis direction in the perforated region (i.e., in a portion of the perforated region near the non-perforated region) can be increased.

Curve 17 shows the case where the width of the non-perforated regions is equal in both end portions in the minor axis direction and the center portion. In this case, the tension acting in the peripheral portion of the perforated region in the major axis direction is smaller than that in the center portion. This is, because the concentration of the stress on the non-perforated regions in the direction in which the color selection electrode is stretched reduces the tension applied in the peripheral portion in the major axis direction in the perforated region (i.e., in a portion of the perforated region near the non-perforated regions).

In the above experiment, the force per unit area in the major axis direction for the present embodiment, which is indicated by curve 16 in FIG. 3, was 0.024 kgf/mm$^2$, measured in the peripheral portion of the perforated region in the major axis direction. In this case, the width of the center portion was a=5 mm and the width of the end portions was b=11.3 mm.

In contrast, in the case of curve 17, wherein the width of the non-perforated regions in the major axis direction is made 5 mm at both end portions with respect to the minor axis direction and in the center portion, the force per unit area in the major axis direction was 0.008 kgf/mm$^2$.

As a result, it was found that by adopting a width ratio of b/a=2.26 for the non-perforated regions of the color selection electrode and thereby making the non-perforated regions in both end portions wider than that in the center portion, insufficient tension in the peripheral portion of the perforated region in the major axis direction can be better avoided than if the width ratio is b/a=1.0 (that is, the width of the end portions is the same as the width of the center portion), and an approximately three times greater force can be applied in the major axis direction.

These effects of avoiding insufficient tension in the peripheral portion of the perforated region in the major axis direction and applying force in the major axis direction arise already when $1.0<b/a$, but in practice, it is preferable that $1.2 \leqq b/a$, that is, the width ratio is greater than in the case of curve 18.

On the other hand, in the case of curve 19 (in which the non-perforated regions in both end portions in the minor axis direction are 6.0 times wider than the center portion), the tension in the peripheral portion in the major axis direction becomes approximately 10% higher than the tension in the center portion, as can be seen in FIG. 3. In this way, as the ratio b/a between the width of the end portions in the minor axis direction and the width of the center portion of the non-perforated regions becomes larger, the tension in the peripheral portion in the major axis direction in the perforated region becomes larger as well. However, if the tension in the peripheral portion in the major axis direction is too large, the peripheral portion of the color selection electrode is stretched harder than the center portion, so that when the color selection electrode vibrates due to shock, the peripheral portion becomes a vibration node that hardly vibrates, and instead, the center portion starts to vibrate too much, which makes it difficult to attenuate the vibration. Therefore, it is preferable that the ratio between the width "b" of the end portions in the minor axis direction and the width "a" of the center portion is not too large. Considering curve 19 (in which b/a=6.0) as a suitable upper limit for b/a, the preferable range is $1.2 \leqq b/a \leqq 6.0$.

Thus, in accordance with the present embodiment, by making the end portions of the non-perforated regions with respect to the minor axis direction, which is provided outside the perforated region in the major axis direction, wider in the major axis direction than the center portion, a stress is applied in a diagonal axis direction of the color selection electrode during stretching. As a result, an insufficient tension in the peripheral portion of the perforated region in the major axis direction can be avoided.

Also, since a greater force can be applied in the major axis direction, the color selection electrode does not warp.

Thus, the color cathode ray tube according to the present embodiment can realize excellent color purity because a sufficient tension is applied to the peripheral portion of the perforated region, so that the color selection electrode is resistant against vibrations and does not warp.

Second Embodiment

The following is a description of the second embodiment.

In this embodiment, half-etched holes (for example, non-penetrating holes with a depth of 30% of the plate thickness, whose shape and pitch are substantially equal to those of the apertures in the perforated region) are provided in the non-perforated regions of the color selection electrode. All other aspects are the same as in the first embodiment.

In this way, the stress applied to the non-perforated region can be reduced, which increases the tension on the peripheral portion of the perforated region of the color selection electrode in the major axis direction.

Accordingly, avoiding insufficient tension in the peripheral portion of the perforated region in the major axis direction makes it possible to provide a color selection electrode that is resistant to vibrations and to realize a color cathode ray tube with excellent color purity.

In the first and second embodiments of the present invention as described above, the edges of the center portion of the non-perforated regions and the two end portions in the minor axis direction are connected by a smooth curve, but the present invention is not necessarily limited to this structure. Instead, the edges of the center portion of the non-perforated regions and the two end portions in the minor axis direction can also be connected with straight lines, thereby smoothing the stress distribution in the end portions in the major axis direction of the color selection electrode and preventing breakage during the stretching.

Also, in the above embodiments, the front surface of the long side members of the frame is curved, and the color selection electrode structure is constructed by welding the color selection electrode to this curved surface, but the present invention is not limited to this configuration. For example, the effect of the present invention can also be attained if the color selection electrode is welded to a flat frame to make a substantially flat surface instead of curved front surface.

In addition, the above embodiments described a color selection electrode with tension applied in the minor axis direction, but the effect of the present invention is not limited to this configuration. The same effect can be obtained when the color selection electrode is welded to short side members of a frame while applying tension in the major axis direction. In this case, the plurality of apertures for passing electron beams are formed such that their long axis coincides with the major axis direction of the color selection electrode. Also, non-perforated regions of the color selection electrode are located outside the perforated region in the minor axis direction, and the end portions of the non-perforated regions are the end portions in the major axis direction.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color cathode ray tube comprising:

an envelope comprising a panel having an inside surface on which a phosphor screen is formed, and a funnel;

a color selection electrode arranged inside said envelope in opposition to said phosphor screen;

a frame for fixing and holding said color selection electrode;

wherein said color selection electrode is stretched by the application of tension in only one of a minor axis direction or a major axis direction;

said color selection electrode comprises a perforated region provided with a plurality of apertures arranged with a predetermined pitch, and a non-perforated region arranged outside said perforated region with respect to a direction that is substantially perpendicular to the direction in which said color selection electrode is stretched, and said non-perforated region gradually widens from a center portion of said non-perforated region towards end portions of said non-perforated region in the direction in which said color selection electrode is stretched and reduces lack of tension in a peripheral region of the color selection electrode stretched one dimensionally, said non-perforated region satisfying $$1.2 \leqq b/a \leqq 6.0$$

wherein "a" is a width of the center portion of said non-perforated region, and "b" is a width of the end portions of said non-perforated region.

2. The color cathode ray tube according to claim 1, wherein an edge of said color selection electrode in the center portion of said non-perforated region and edges of the end portions of said non-perforated region are connected by a smooth curve.

3. The color cathode ray tube according to claim 1, wherein an edge of said color selection electrode in the center portion of said non-perforated region and edges of the end portions of said non-perforated region are connected by a straight line.

4. The color cathode ray tube according to claim 1, wherein half-etched holes are provided in said non-perforated region.

5. The color cathode ray tube according to claim 1, wherein the direction in which said color selection electrode is stretched is the minor axis direction.

6. A color cathode ray tube according to claim 1, wherein a width of said color selection electrode in the direction perpendicular to the direction in which said color selection electrode is stretched gradually widens from a center portion towards end portions in the direction in which said color selection electrode is stretched.

7. A color cathode ray tube comprising:

an envelope comprising a panel having an inside surface on which a phosphor screen is formed, and a funnel;

a color selection electrode arranged inside said envelope in opposition to said phosphor screen;

a frame for fixing and holding said color selection electrode;

wherein said color selection electrode is stretched by the application of tension in only one of a minor axis direction or a major axis direction;

said color selection electrode comprises a perforated region provided with a plurality of apertures arranged with a predetermined pitch, and a non-perforated region arranged outside said perforated region with respect to a direction that is substantially perpendicular to the direction in which said color selection electrode is stretched, said non-perforated region gradually widens from a center portion of said non-perforated region towards end portions of said non-perforated region in the direction in which said color selection electrode is stretched and said color selection electrode satisfies $$1.2 \leqq b/a \leqq 6.0$$

wherein "a" is a width of the center portion of said non-perforated region, and "b"is a width of the end portions of said non-perforated region.

8. A color cathode ray tube comprising an envelope comprising:

a panel having an inside surface on which a phosphor screen is formed, and a funnel;

a color selection electrode arranged inside said envelope in opposition to said phosphor screen; and a frame for fixing and holding said color selection electrode, wherein said color selection electrode is stretched by the application of tension in only one of a minor axis direction or a major axis direction, said color selection electrode comprises a perforated region provided with a plurality of apertures, through which electron beams pass, said apertures being arranged with a predetermined pitch, and a non-perforated region arranged adjacent to said perforated region and outside said perforated region with respect to a direction that is substantially perpendicular to the direction in which said color selection electrode is stretched;

said non-perforated region gradually widens from a center portion of said non-perforated region towards end portions of said non-perforated region in the direction in which said color selection electrode is stretched; and a width of said color selection electrode in the direction perpendicular to the direction in which said color selection electrode is stretched gradually widens from a center portion towards end portions in the direction in which said color selection electrode is stretched wherein said color selection electrode satisfies $$1.2 \leqq b/a \leqq 6.0$$

wherein "a" is a width of the center portion of said non-perforated region, and "b" is a width of the end portions of said non-perforated region.

* * * * *